US005144372A

United States Patent [19]

Miyamoto et al.

[11] Patent Number: 5,144,372

[45] Date of Patent: Sep. 1, 1992

[54] COPYING MACHINE OPERABLE IN SIMULTANEOUS MULTI-COLOR MODE

[75] Inventors: Hirohisa Miyamoto; Kenzo Nagata, both of Osaka, Japan

[73] Assignee: Minolta Camera Kabushiki Kaisha, Osaka, Japan

[21] Appl. No.: 771,810

[22] Filed: Oct. 8, 1991

Related U.S. Application Data

[63] Continuation of Ser. No. 273,575, Nov. 21, 1988, abandoned.

[30] Foreign Application Priority Data

Nov. 20, 1987 [JP] Japan ..... 62-294507

[51] Int. Cl.[5] ..... G03G 15/01

[52] U.S. Cl. ..... 355/328; 355/202; 358/453

[58] Field of Search ..... 355/202, 206, 209, 218, 355/244, 326, 328; 358/453

[56] References Cited

U.S. PATENT DOCUMENTS 3,914,043 10/1975 McVeigh ..... 355/326
4,734,789 3/1988 Smith et al. ..... 355/218 X
4,745,491 5/1988 Kishi et al. ..... 355/218 X
4,794,421 12/1988 Stoudt et al. ..... 355/326 X
4,801,972 1/1989 Kusumoto et al. ..... 355/326 X
4,819,019 4/1989 Egawa et al. ..... 355/244 X
4,837,599 6/1989 Ohira et al. ..... 355/218
4,885,611 12/1989 Higashio et al. ..... 355/245
4,935,781 6/1990 Ito et al. ..... 355/328 X

FOREIGN PATENT DOCUMENTS 61-203474 9/1986 Japan .

*Primary Examiner*—Richard L. Moses
*Assistant Examiner*—J. E. Barlow, Jr.
*Attorney, Agent, or Firm*—Burns, Doane, Swecker & Mathis

[57] ABSTRACT

A copying machine with plural developing units being capable of performing at least one edition mode and a simultaneous multi-mode in which the developing unit is switched from one to another on the way through one copying action is disclosed. In the simultaneous multi-mode, the position at which the developing unit is to be switched is designated by a position designation device such as keys provided on an operation panel and/or an editor, if connected to the copying machine. In this case, only one coordinate of the designated position in the sub-scan direction is employed to designate the switching position for the developing unit.

7 Claims, 9 Drawing Sheets

COPYING MACHINE OPERABLE IN SIMULTANEOUS MULTI-COLOR MODE

This application is a now abandoned continuation of application Ser. No. 07/273,575, filed Nov. 21, 1988.

BACKGROUND OF THE INVENTION

1. Field of the Invention

The present invention relates to a copying machine being operable in simultaneous multi-color mode in which the developing unit is switched from one to another on the way through one copying action to obtain copy portions of which are developed with different colors in one copy cycle.

2. Description of Prior Art

For instance, in JP-A 61-203474, there is proposed a copying machine operable in the simultaneous multi-color mode as mentioned above.

In order to perform the simultaneous multi-color mode, it is necessary to designate beforehand at least one position for switching one developing unit to another developing unit. This necessitates a position designation means therefor.

However, in a usual copying machine, a number of editorial functions other than the simultaneous multi-color mode are provided and the operation panel thereof is occupied with various keys and indicators for performing individual functions. If a position designation means and a display means for displaying the designated position are newly added to the operation panel in order to effect the simultaneous multi-color mode, the operation panel becomes much more complicated which increases the possibility of misoperation.

In a copying machine having a composite (superposition) copy mode, an editorial means for editing images to be copied is provided on the operation panel. As is well known to those skilled in the art, in the composite copy mode, two partial images of different documents are copied composited on a copy paper by two copy actions. Upon performing the composite copy mode, each position of two partial images is designated with use of the editorial means beforehand.

This editorial means for the composite copy mode is common to that for the simultaneous multi-color mode in designating a position on an image of a document.

Further, an external editorial apparatus with a stylus pen has been known which is connectable to a copying machine. The editorial apparatus has various functions such as moving, deleting, and trimming of image and the like through which desired editorial data are entered to the copying machine to enable it to operate in a designated editorial mode. In this editorial apparatus, the designation of position can be done by indicating a point corresponding to a desired position on a document set on the panel thereof with use of the stylus pen.

In this case, the position designation means for editing images is also available to that for designating a position to perform the simultaneous multi-color mode.

SUMMARY OF THE INVENTION

One object of the present invention is to provide a copying machine with an editorial means including a position entry means for designating each position of images to be edited in which a simultaneous multi-color mode can be performed and, when the simultaneous multi-color mode is designated, a desired position therefor can be entered with use of the position entry means of the editorial means.

Another object of the present invention is to provide a copying machine being cooperative with an editor in which a position for performing the simultaneous multi-color mode, if it is designated, can be entered through the editor.

In order to accomplish these objects, according to the present invention, there is provided a copying machine comprising: an image forming means including plural developing units each of which contains a developer of a color different from each other; a mode designation means for designating a simultaneous multi-color mode in which the developing unit is switched from one to another on the way through one copying action; an editorial designation means for designating a kind of edition for editing images to be copied which includes a position entry means for designating an arbitrary position on an image of a document; and a control means for operating said image forming means in said simultaneous multi-color mode so as to switch the developing unit from one to another at the position entry means after the designation of said mode by said mode designation means.

Accordingly, when the simultaneous multi-color mode is designated, a position designated with the use of the position entry means of the editorial means is automatically set as the position at which the developing unit is to be switched from one to another to perform the simultaneous multi-color mode.

According to another feature of the present invention, there is provided a copying machine comprising: an image forming means including plural developing units each of which contains a developer of a color different from each other; a mode designation means for designating a simultaneous multi-color mode in which the developing unit is switched from one to another on the way through one copying action; an editorial designation means for designating a kind of edition for editing images to be copied which includes a position entry means for designating an arbitrary position of an image on a panel board having a size corresponding to the maximum size of a document; and a control means for operating said image forming means in said simultaneous multi-color mode so as to switch the developing unit from one to another at the position when it is designated by said position entry means after the designation of said mode by said mode designation means.

In this feature of the present invention, a position designated on the panel board with use of the position entry means is automatically set as the position at which the developing unit is to be switched from one to another to perform the simultaneous multi-color mode.

According to a further feature of the present invention, the copying machine includes a first and a second position entry means and, when the simultaneous multi-color mode is designated, a position designated through either one of the first and second position entry means is automatically set as the position at which the developing unit is to be switched from one to another to perform the simultaneous multi-color mode.

BRIEF DESCRIPTION OF THE DRAWINGS

These and other objects and features of the present invention will become more apparent when the preferred embodiment of the present invention is described in detail with reference of accompanied drawings in that;

FIG. 4(*b*) is an enlarged plan view of the portion of FIG. 4(*a*);

DETAILED DESCRIPTION OF THE PREFERRED EMBODIMENT

Figure 1:
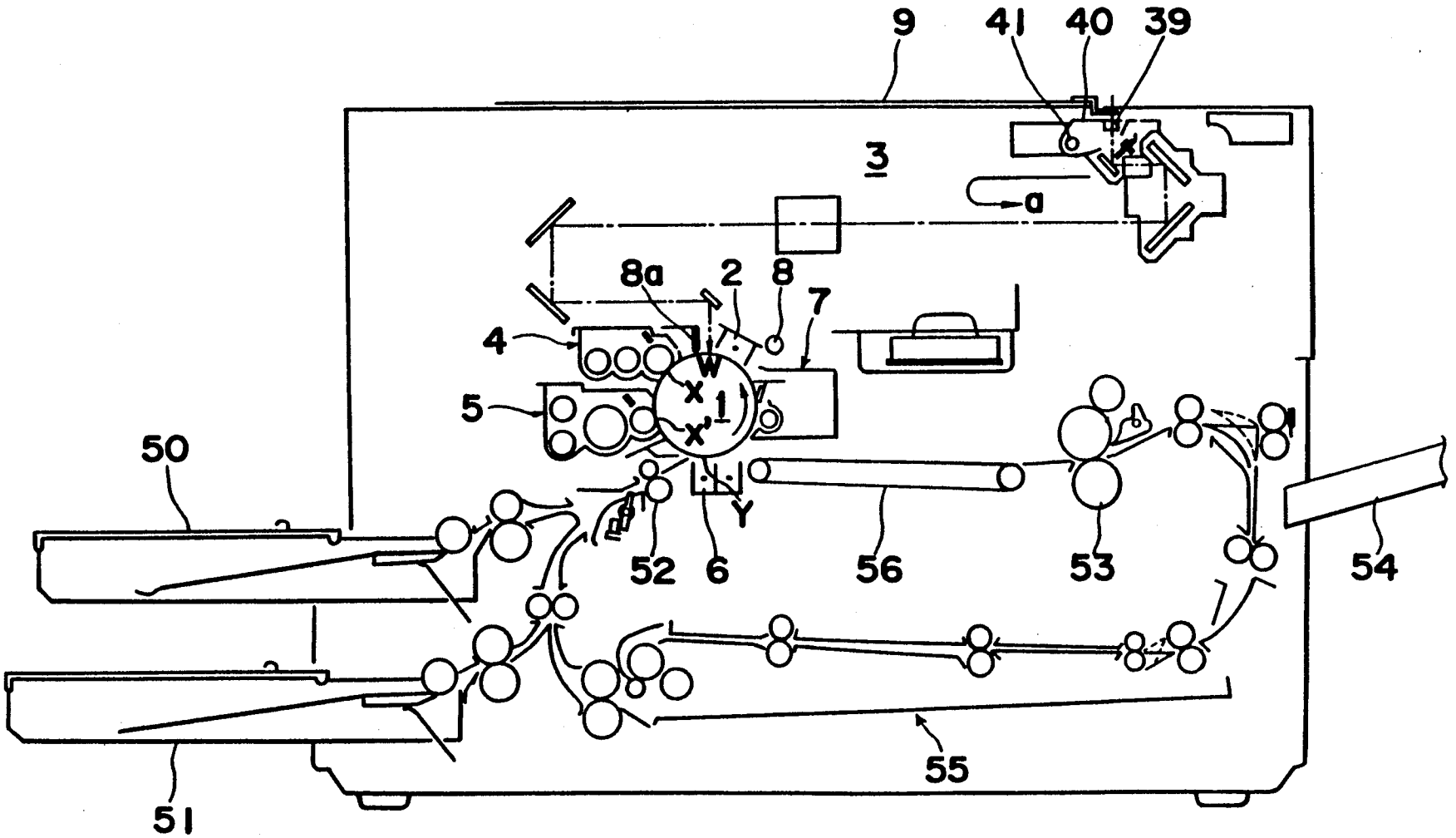
FIG. 1 is a schematic cross-sectional view of a copying machine to which the present invention is applied.

FIG. 1 is a schematic cross-sectional view of an electro-photographic copying machine with plural developing units to which the present invention is applied.

Since essential structures of the electro-photographic copying machine are well known to those skilled in the art, those are explained through explanation of the normal copying action of the copying machine.

A photoconductor drum 1 is electrified by a discharge by an electrifying charger 2 during rotation of the drum 1 in the counter-clockwise direction in FIG. 1.

A document set on a document platen 9 is scanned optically by a scanner 40 of an optical scanning system 3 including an exposing lamp 41, plural reflection mirrors and a focusing lens assembly and the image obtained by the scan is projected onto the electrified surface of the drum at an exposure position w to form a latent image corresponding to the document image thereon.

Charge on portions of the drum 1 unnecessary for the document image is erased by an eraser 8*a* comprised of an array of LEDs light emitting devices.

The latent image thus formed is visualized with toner by either of first and second developing units 4 and 5 in a developing zone X or X'. Thus, the toner image corresponding to the document image is formed on the surface of the drum 1.

Meanwhile, a copy paper is fed from either of two paper containing sections 50 and 51, via a paper feeding means, to a pair of timing rollers 52. The pair of timing rollers 52 feeds the copy paper to a transferring area Y of the drum 1 opposite to a transfer charger 6 at a timing in synchronism with the toner image on the drum 1. The toner image is transferred onto the copy paper by the transfer charger 6.

Then, the paper is conveyed by a conveyor belt 56 to a pair of fixing rollers 53 in order to fix the toner image onto the copy paper thermally and the copy paper is discharged onto a tray 54.

If a duplex (double side) copy mode for copying respective images on both sides of a copy paper or a composite copy mode for copying two partial images on one side of a copy paper is selected, the copied paper is conveyed to a duplex apparatus 55 provided in the main body of the copying machine. The duplex apparatus 55 feeds the conveyed copy paper to the pair of timing rollers 52 again. If the duplex copy mode is selected, the duplex apparatus 55 reverses the conveyed copy paper before feeding it to the pair of timing rollers 52. In the composite copy mode, the conveyed paper is fed as it is.

Then, the second copy operation is done to obtain a duplex copy or a composite copy.

After transferring the toner image to the copy paper, the toner remaining on the surface of the photoconductor drum 1 is removed by a cleaning device 7 and the charge remaining thereon is erased by an eraser lamp 8 for the next copy action.

The copying machine according to the present invention is able to perform the simultaneous bi-color copy mode together with the duplex and the composite copy modes. In this simultaneous bi-color copy mode, the developing color is changed from one to another on the way through one copy action for copying an image of a document.

In other words, the first portion of an image is developed in a color (for example in red) and the rest of the image is developed in another color (for example in black) during one copy action.

In order for that to occur, each of the developing units 4 and 5 provides a special mechanism as will be explained later and the editorial operation for the simultaneous bi-color copy mode can be done with use of an operation panel having a known composition.

Figure 2:
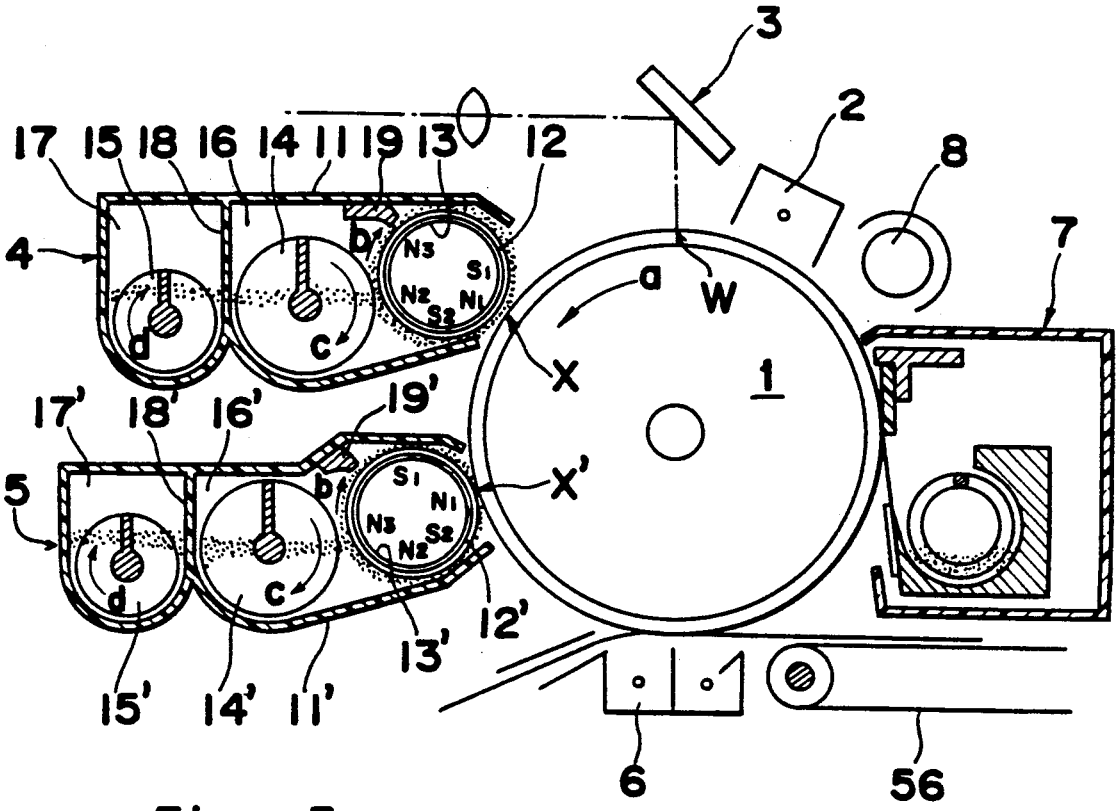
FIG. 2 is an enlarged cross-sectional view showing plural developing units arranged around a photoconductor drum.
Figure 3:
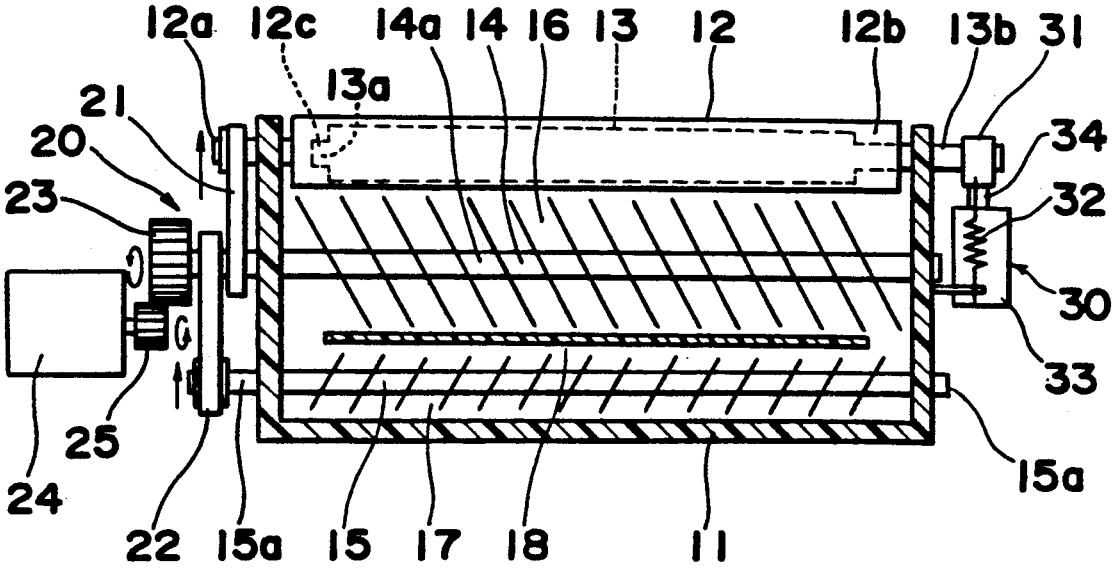
FIG. 3 is an enlarged cross-sectional view of the developing unit sectioned along the longitudinal direction thereof.

At first, the structures of the first and second developing units 4 and 5 are explained referring to FIGS. 2 and 3.

The first and second developing units 4-and 5 have a substantially same structure as is apparent from FIG. 2.

For simplicity, the structure of the first developing unit 4 is mainly explained. In FIG. 2, each element of the second unit 5 is numbered with the same reference numeral of each corresponding element of the first developing unit 4 but with a prime.

As shown in FIG. 2, a developing sleeve 12, a supply roller 14 and a screw conveyor 15 are arranged side by side from the side of the photoconductor drum 1 in a developing tank 11.

In the first developing unit 4, a developer including magnetic carrier and insulated color toner is contained and, in the second developing unit 5, a developer including magnetic carrier and insulated black toner is contained.

The developing sleeve 12 of a cylindrical configuration is made of a non-magnetic electrically conductive material and the outer surface thereof is made uneven in a microscopic sense by sand-blast processing. Further, a means 19 for restricting the height of ear formed with carrier and toner is arranged in an inside area of the tank 11 which locates opposite to the developing area X. The supply roller 14 and the conveyor screw 15 are arranged in conveying passages 16 and 17, respectively, which are partitioned by a partition wall 18. These conveying passages 16 and 17 are connected with each other at respective lengthwise ends of the tank 11, as shown in FIG. 3.

Upon operation of the developing unit, gears 23 and 25 are driven when a clutch means 24 is energized and, thereby, belts 21 and 22 are driven to rotate respective axes 12*a*, 14*a* and 15*a* of the developing sleeve 12, the supply roller 14 and conveyor screw 15, respectively. As shown in FIG. 2, these three members, the developing sleeve 12, the supply roller 14 and the conveyor screw 15 are rotated in directions indicated by arrows b, c and d, respectively and, according to these rotations, toner is fed, via the conveyor screw 15 and the supply roller 14, to the developing sleeve 12 and is supplied to the developing area X passing through the gap defined between the developing means 12 and the ear height restriction means 19.

Further, a magnet roller 13 is coaxially inserted into the developing sleeve 12. The magnet roller 13 has five magnets $S_1$, $N_1$, $S_2$, $N_2$ and $N_3$ (S and N indicate respective poles of magnets) arranged spaced with each other along the periphery thereof and each magnet is formed elongated along the axial direction of the roller 13.

One end 13*a* of the rotation axis of the magnet roller 13, as shown in FIG. 3, is supported in a bearing recess 12*c* and the other end 13*b* thereof is supported rotatably by the side wall of the developing tank 11. The other end 13*b* protrudes from outside of the side wall and supports a center portion of a lever 31 arranged parallel to the side wall, one end of which is biased by a coil spring 32. The other end of the lever 31 is connected to the free end of a plunger 34 which is actuated by a solenoid 33. When the solenoid 33 is energized, the lever 31 is rotated against the spring force of the spring 32 by the plunger 34 and, thereby, the magnet roller 13 is rotated by a predetermined angle.

In a state that the solenoid 33 is energized but the clutch 24 is disenergized, the conveyor screw 15, the supplying roller 14 and the developing sleeve 12 are stopped not to supply the toner and the magnet $N_3$ is positioned so as to oppose to the ear height restriction means 19. In this state, the developing area X locates between the magnets $N_1$ and $S_1$. The toner on the developing sleeve 12 is distributed according to the distribution of magnetic flux generated by the magnets in such a manner that the thickness of toner becomes thick on respective areas of the magnets and thin on areas inbetween adjacent magnets. Accordingly, in this state, the gap between the developing sleeve 12 and the ear height restricting means 19 is plugged with the toner but the toner on the surface area opposing to the developing area X becomes thin and, accordingly, does not adhere to the photoconductor drum 1.

On the contrary, if the solenoid 33' of the second developing unit 5 is disenergized but the clutch 24' thereof is energized, the conveyor screw 15', supply roller 14' and the developing sleeve 12' are rotated and thereby, the toner is supplied according to the rotation of the developing sleeve 12'. In this state, the ear height restriction means 19' locates inbetween the magnets $N_3$ and $S_1$ and, thereby, the gap is opened to supply the toner to the developing area X' which is opposed to the magnet $N_1$. As stated above, the toner on the area of the magnet $N_1$ exists in the thick state which allows the toner to adhere to the photoconductor drum 1.

Figures 4A, 4B:
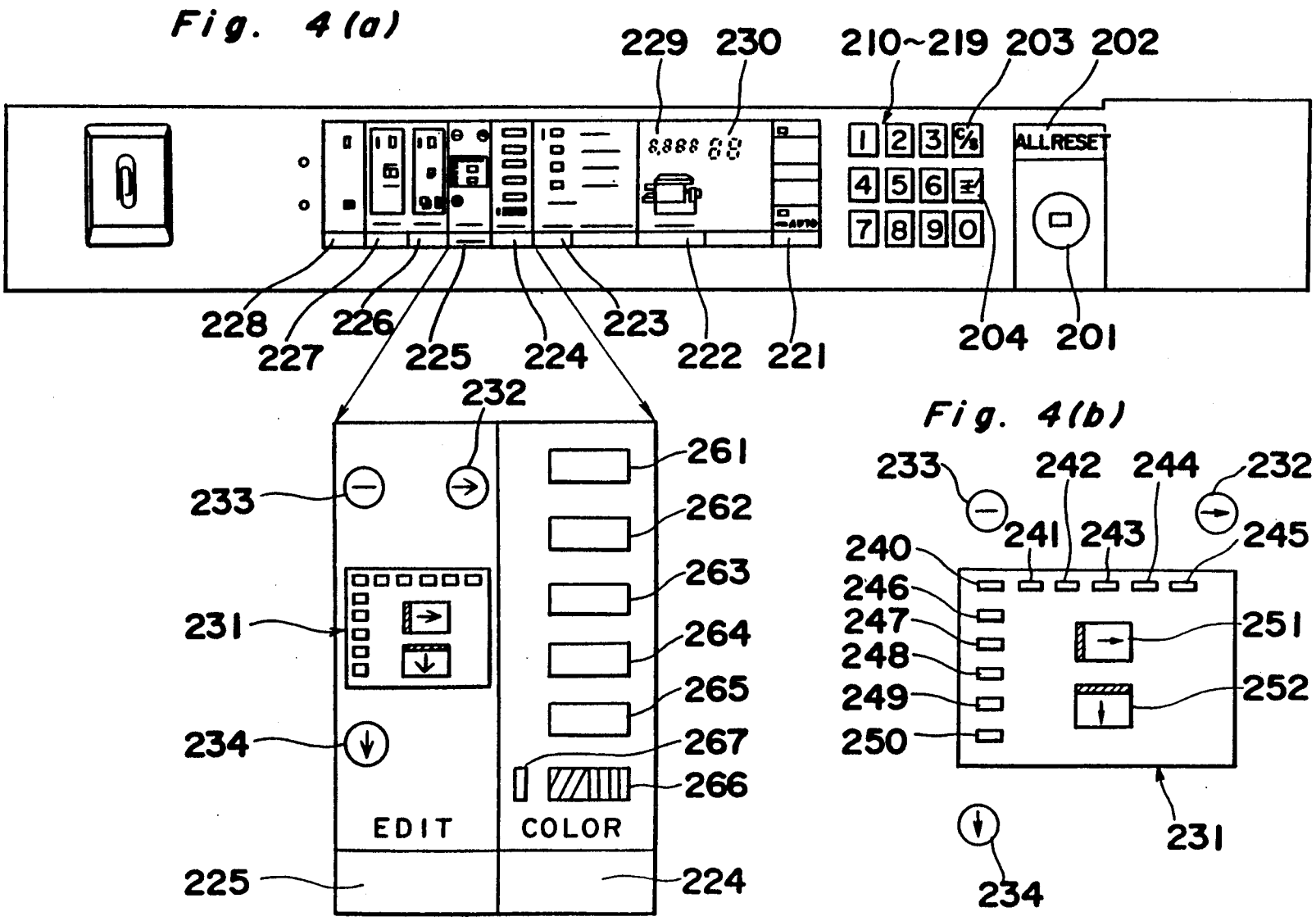
FIG. 4(*a*) is a plan view of an operation panel of the copying machine.

FIG. 4(*a*) shows a plan view of the operation panel of the copying machine together with an enlarged plan view of a portion thereof.

A print key 201 for starting a copy process, an all-reset key 202 for resetting the copy mode into the initial mode, ten keys 210 to 219 for setting a number of copies, C/S key 203 for clearing the set number of copies and for stopping a multi-copy action and an interruption key 204 are arranged on the operation panel.

On the operation panel, there is provided a display section for setting individual copy modes and displaying various indications therefor. In this display section, the following keys are provided:

AUTO key 221 for switching the auto-exposure control mode to the manual exposure mode or vice versa;
PAPER key 222 for selecting a desired paper size;
ZOOM key 223 for setting a desired zooming magnification;
COLOR key 224 for selecting desired toner colors and the simultaneous bi-color copy mode;
EDIT key 225 for designating an edition mode;
COPY key 226 for selecting the kind of copy among the ordinal, double side and composite copy mode;
ORIGINAL key 227 for designating the kind of original to be copied among single sided, book and letter originals;
MARGIN key 228 for setting a desired margin.

Further, a display means 229 for displaying the designated magnification and a display means 230 for displaying the designated number of copies.

In FIG. 4(*a*), areas for setting editorial data and for selecting one or more developing colors are shown in an enlarged scale.

The EDIT key 225 is provided at the bottom of the EDIT area and, at the central portion thereof, a display area 231 having LED indicators 240 to 250 for indicating an editorial position which are arranged along the upper and left sides thereof, respectively, and three keys 232, 233 and 234 for designating a desired editorial position, as shown in FIG. 4(*b*).

When the EDIT key 225 is operated, it is possible to designate an area to be erased in the paper feeding direction.

As shown in FIG. 4(*b*) more particularly, the six LED indicators 240 to 245 are arranged along the upper side of the display area 231 at an equal pitch and, also, LED indicators 240, 246 to 250 are arranged along the left side thereof at an equal pitch. Each of LED indicators, when lit, indicates a position on the document platen 9 in units of 50 mms in the horizontal direction (X) and in units of 70 mms in the vertical direction (Y) and when measured from the origin point corresponding to the upper left corner of an original. A position can be designated on the edition area 231 as if the original is set so as to coincide the upper left corner thereof with that of the edition area 231 while keeping the side to be copied upward although it is set so as to coincide the upper left corner of the original with the upper right corner of the document platen upon copying.

In this preferred embodiment, the editorial position can be designated more precisely in units of 10 mms with use of a choice function. In this case, the display means 229 provided for displaying the magnification, displays the position in the units of 10 mms in the area defined by adjacent LED indicators. Namely, the editorial position can be designated with 30 steps in the horizontal direction and with 42 steps in the vertical direction on the edition area 231. Two indicators 251 and 252 arranged in the edition area 231 are provided for indicating the orientation of an original to be copied.

Meanwhile, when the EDIT key 225 is operated in the edition mode, the area to be copied and the area to be erased are replaced with each other. In this state, the LED indicators having been lit are turned off and those not lit are turned on to show the replacement of these areas. Thereafter, when the EDIT key 225 is operated further, the edition mode is released to allow the display means 229 to display the magnification.

When both keys 232 and 233 having symbols "→" and "−" are pushed down at the same time, the edition mode is set and the editorial position is shifted in the horizontal direction step by step according to the number of times of operation of the keys. Also, the lighting position is shifted step by step in accordance with the shift of the editorial position.

When both keys 234 and 233 having symbols "↓" and "−" are pushed down at the same time, the editorial position is shifted step by step downwardly and the lighting position is shifted similarly.

Further, COLOR key 224 is provided at the bottom end of the color area. The simultaneous bi-color mode can be selected by operating the COLOR key 224. This key 224 is formed as a kind of rotation key and the upper (first) developing unit 4, the lower (second) developing unit 5 and the simultaneous bi-color copy mode are selected in turn by operating it.

When either one of the first and second developing units 4 and 5 is designated, the color of toner contained therein is indicated by lighting the corresponding indicator among indicators 261 to 265 of "BLACK", "RED", "BLUE", "YELLOW" and "WHITE".

When the simultaneous bi-color copy mode is selected, an indicator 267 is lit at the same time to indicate a symbol 266 for showing it.

Figure 6:
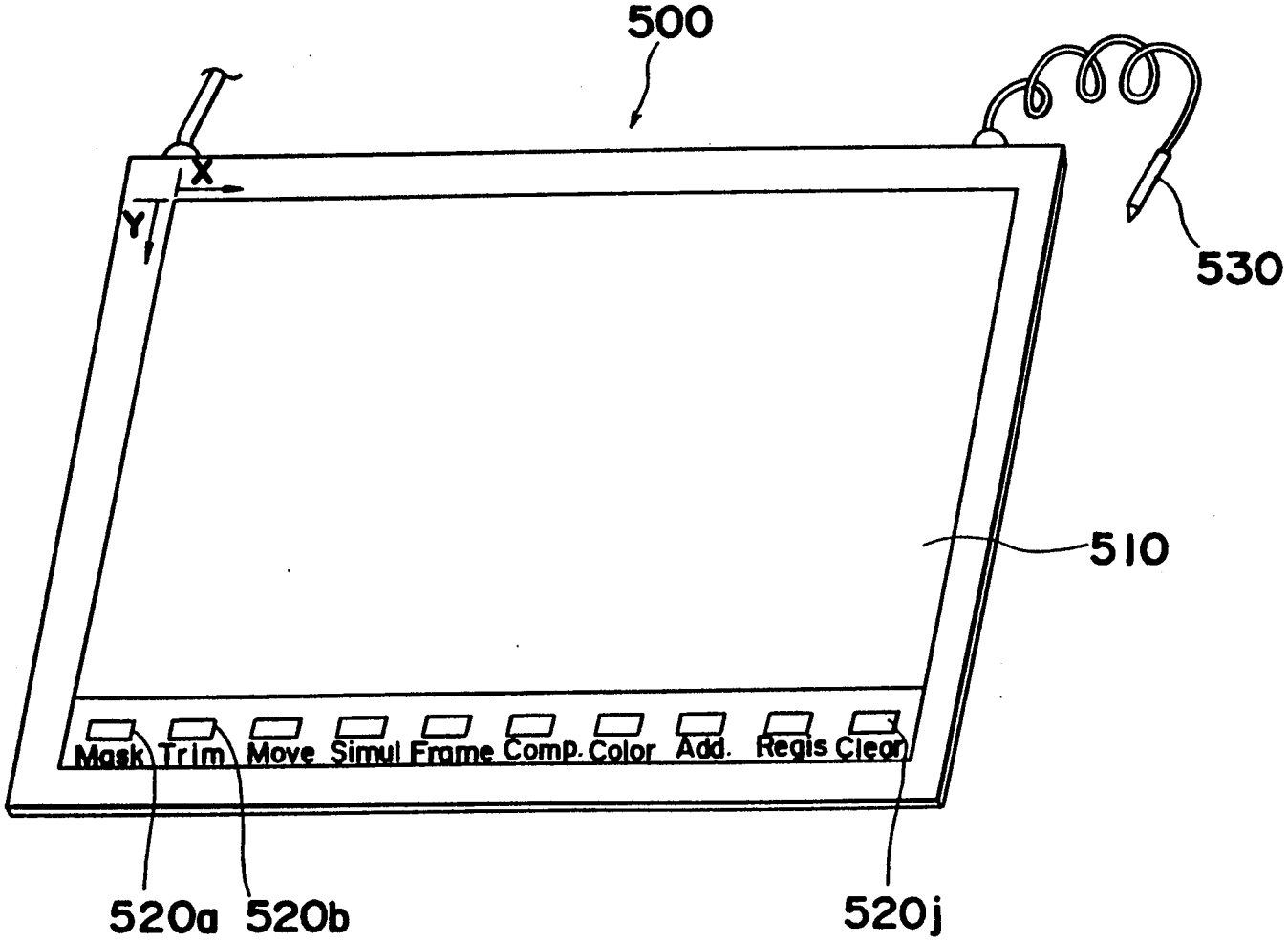
FIG. 6 is a perspective view of an editor cooperative with the copying machine.

Next, the structure of the editor will be explained referring to FIG. 6.

A tablet 510 for the edition of an image is mounted on the upper surface of the editor 500 and plural keys 520*a* to 520*j* for designating editorial modes are arranged along the lower side thereof.

After setting an original on the tablet 510 so as to coincide the upper left corner of the former with that of the latter, a desired position on the former by pushing down a stylus pen 530 can be designated thereat.

Various editorial modes can be selected by operating a desired key among keys 520*a* to 520*j*. In this preferred embodiment, modes such as "masking", "trimming", "moving", "simul-bi-color" "framing", "compositing", "color copy", "adding image", "registering" and "clearing" are provided.

The detection of the point instructed by the stylus pen 530 is made with use of two sheets arranged beneath the tablet 510 (not shown). The first sheet has a number of resistor lines arranged parallel to each other in the vertical direction at an equal small pitch and the second sheet arranged beneath the first sheet with a small gap has a number of resistor lines arranged parallel to each other in the horizontal direction at an equal small pitch and, accordingly, a matrix switch is formed by these sheets. When a position of the tablet 510 is pushed down by the stylus pen 530, the corresponding vertical and horizontal resistor lines are contacted with each other at that point to allow an electric current to flow therethrough and, thereby, the position is detected electrically.

As is well known to those skilled in the art, a switching device is installed in the stylus pen 530 in order to detect that it is pressed on the tablet 510. The editor 500 designates the position only when both of signals from the matrix switch and the switching device of the stylus pen 500 are detected at the same time. In other words, the position is not designated if it is instructed with a means other than the stylus pen 530.

Figure 5:
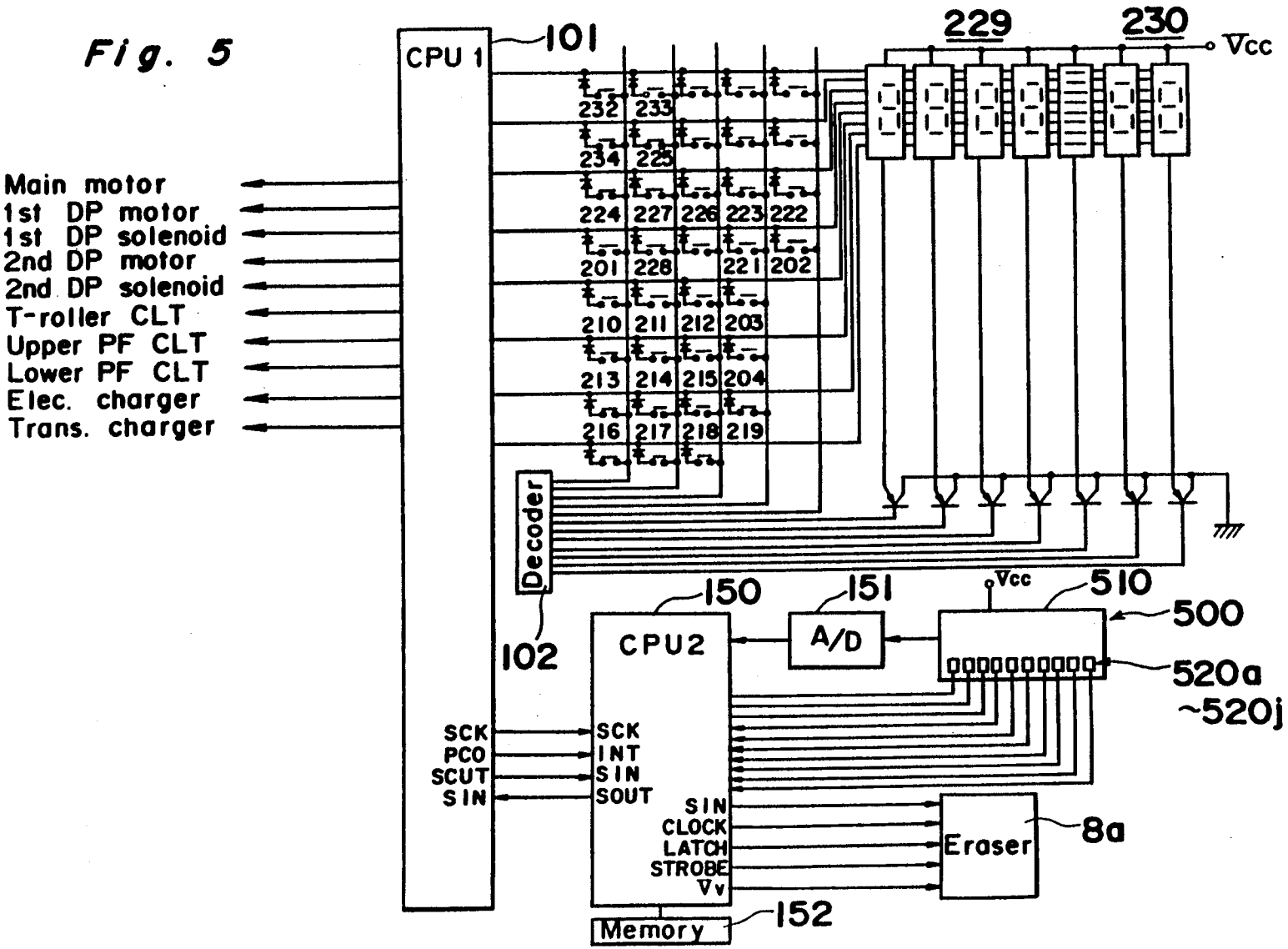
FIG. 5 is a block diagram of the control circuit of the copying machine.

FIG. 5 shows a block diagram of a control circuit for controlling the copying machine and the editor 500 connected thereto.

The control circuit has a first CPU 101 for controlling the main routine of the copying machine and a second CPU 150 for controlling the external editor 500 and the eraser 8*a*.

To the first CPU 101, a decoder 102, a key matrix comprised of various keys and indicators 201 to 234, individual drivers for the main motor, the first developing motor, the first developing solenoid, the second developing motor, the second developing solenoid, clutches of the timing roller 52, upper and lower paper feeding rollers, the electrifying charger 2, the transfer charger 6 and the like are connected.

The first CPU 101 controls main actions such as copy action, temperature adjusting action and the like according to the key operation and/or data from various sensors.

The second CPU 150 receives coordinate data from the editor 500 through an A/D convertor 151 and key signals therefrom. Further, it controls individual LEDs of the eraser 8*a* in accordance with commands from the first CPU 101 and signals from the editor 500.

Next, the copy action in the simultaneous bi-color copy mode will be explained.

If the simultaneous bi-color copy mode is designated by the operation of the COLOR key 224 arranged on the operation panel, data entry with use of shift keys (232, 233) provided in the edition area 231 is assumed as data entry for designating a switching position of the developing unit in the simultaneous bi-color mode. Accordingly, when a desired switching position is designated by operating shift keys 232 and 233, it is input into the first CPU 101.

If the editor 500 is connected to the copying machine, the simultaneous bi-color copy mode is designated also by operating the mode designation key 520*d* arranged on the editor 510 with use of the stylus pen 530. In this mode, the coordinate data of the designated position in the direction orthogonal to the scan direction is neglected and the switching position is set with use of only the coordinate data in the scan direction. This switching position is input into the second CPU 150 at first and, therethrough, is input into the first CPU 101.

Then, the COPY key 201 is pushed down in the copy ready state, the copy action is started. When the top of a latent image having been formed on the photoconductor drum 1 is rotated to the developing area X, the first developing unit 4 begins to develop the latent image with color toner. When the designated switching position comes to the developing area X, the development by the first developing unit 4 is stopped. Thereafter, when it comes to the developing area X', the second developing unit 5 begins to develop the rest portion of the latent image. Thus, the bi-colored toner image is formed on the photoconductor drum 1, transferred onto a copy paper and fixed thermally. It is to be noted that two or more switching positions can be set in the simultaneous bi-color mode.

Figure 7:
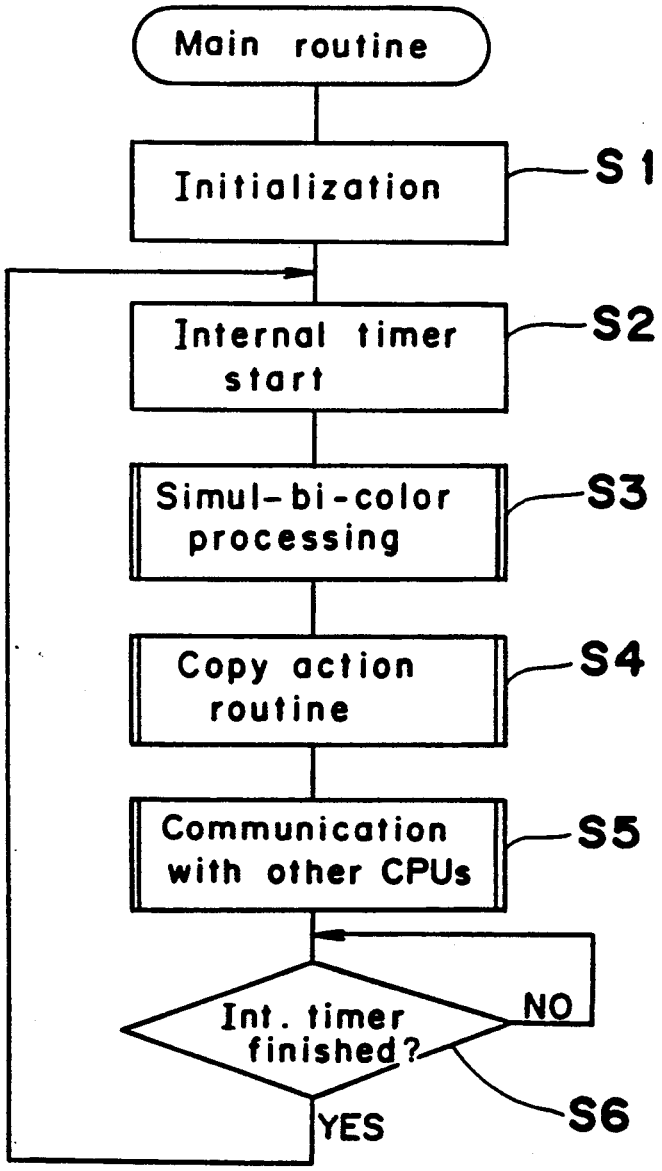
FIG. 7 is a flow chart of the main routine to be executed by the CPU 1 of the control circuit shown in FIG. 5.

FIG. 7 shows a flow chart of the main routine to be executed by the first CPU 101.

When the program is started by resetting the first CPU 101, the copying machine is initialized at step S1 by clearing RAM of the first CPU 101, initializing individual resisters, setting the initial mode and the like.

Next, an internal timer is started at step S2 which is defined in the first CPU 101 and is initialized at step S1.

Then, the subroutine for the simultaneous bi-color copy mode is executed at step S3 and the copy action routine is executed at step S4. Thereafter, the communication between the first CPU 101 and another CPU or the editor, if connected, is executed at step S5. When all of these steps are executed, the process returns to step S2 after confirming the time-up of the internal timer.

Figure 8:
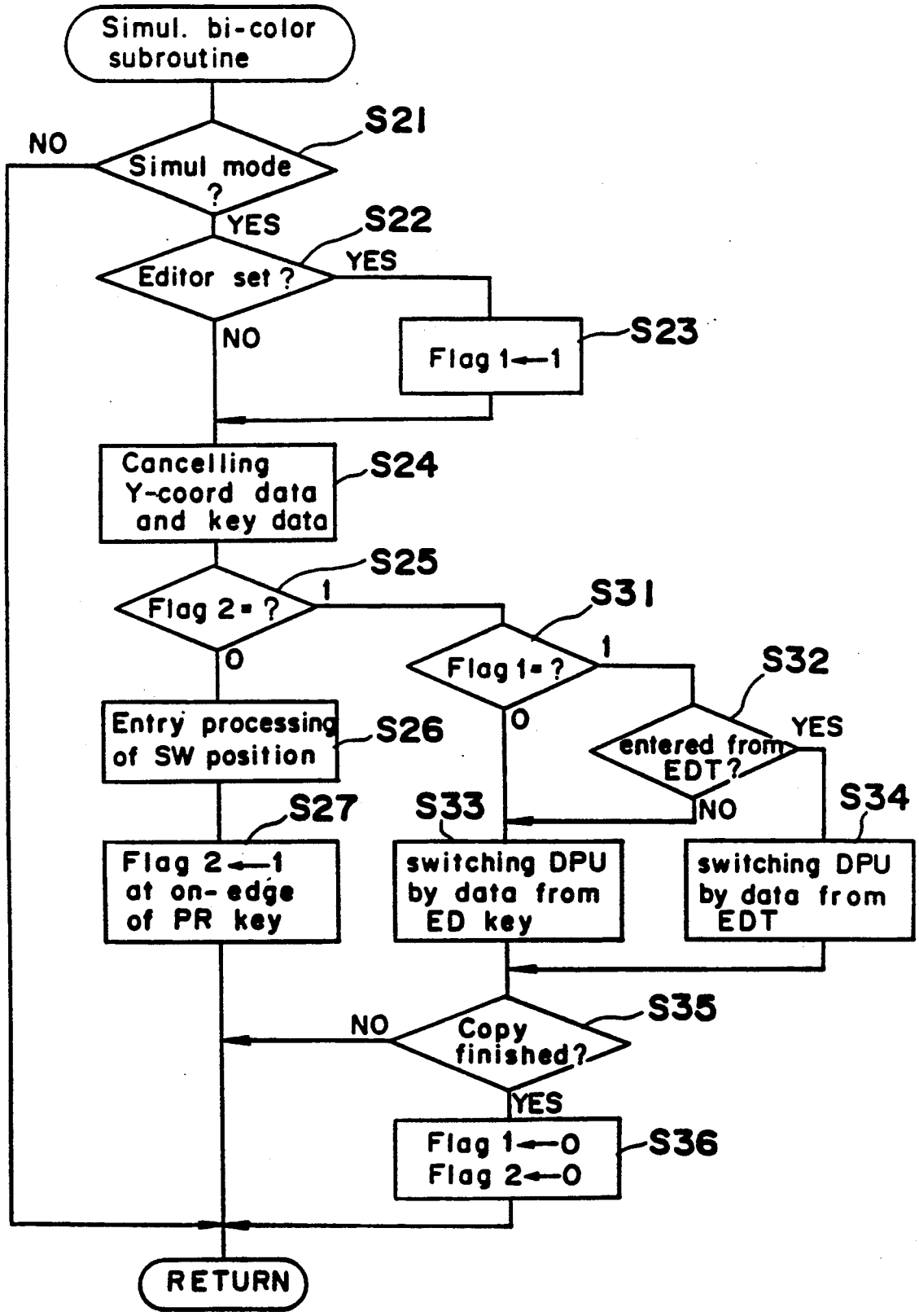
FIG. 8 is a flow chart of the subroutine for the simultaneous bi-color mode.

FIG. 8 shows a flow chart for the subroutine (S3) of the simultaneous bi-color copy mode.

At first, it is checked at step S21 whether the simultaneous bi-color mode is selected or not. If it is not selected, the process returns to the main routine at once.

If it is selected, the process goes to step S22 to check whether or not the editor 500 is connected to the copying machine.

If the editor 500 is connected, Flag 1 is set at "1" at step S23.

Thereafter, at step S24, Y-coordinate data of the designated point corresponding to the main scan direction is cancelled together with key entry data by the edition key.

Then, it is checked at step S25 whether Flag 2 for indicating "in copying" is set at "1" or not. If it is not set, the process goes to step S26 in order to execute an entry processing of the switching position designated by shift keys 232 and 233 on the operation panel or by the editor 500. Thereafter, the Flag 2 is set at "1" by "on-edge" of the PRINT key 201 at step S27. The term "on-edge" is used for indicating the timing at which a key or a sensor is switched from the off-state to the on-state.

If "in-copying" state is detected at step S25, the process goes to step S31 in order to check whether the Flag 1 is set or not.

If it is not set or no data is entered from the editor 500 although it is set (NO at step S32), the process goes to step S33 in order to set data entered from the edition area of the operation panel as the switching position.

If data is entered from the editor (YES at step S32), the process goes to step S34 in order to set data entered from the editor 500 as the switching position.

Then, if it is confirmed that the present copy action is completed at step S35, both of Flags 1 and 2 are reset at "0" at step S36. If the copy action is not completed, the process returns to the main routine.

Figure 9:
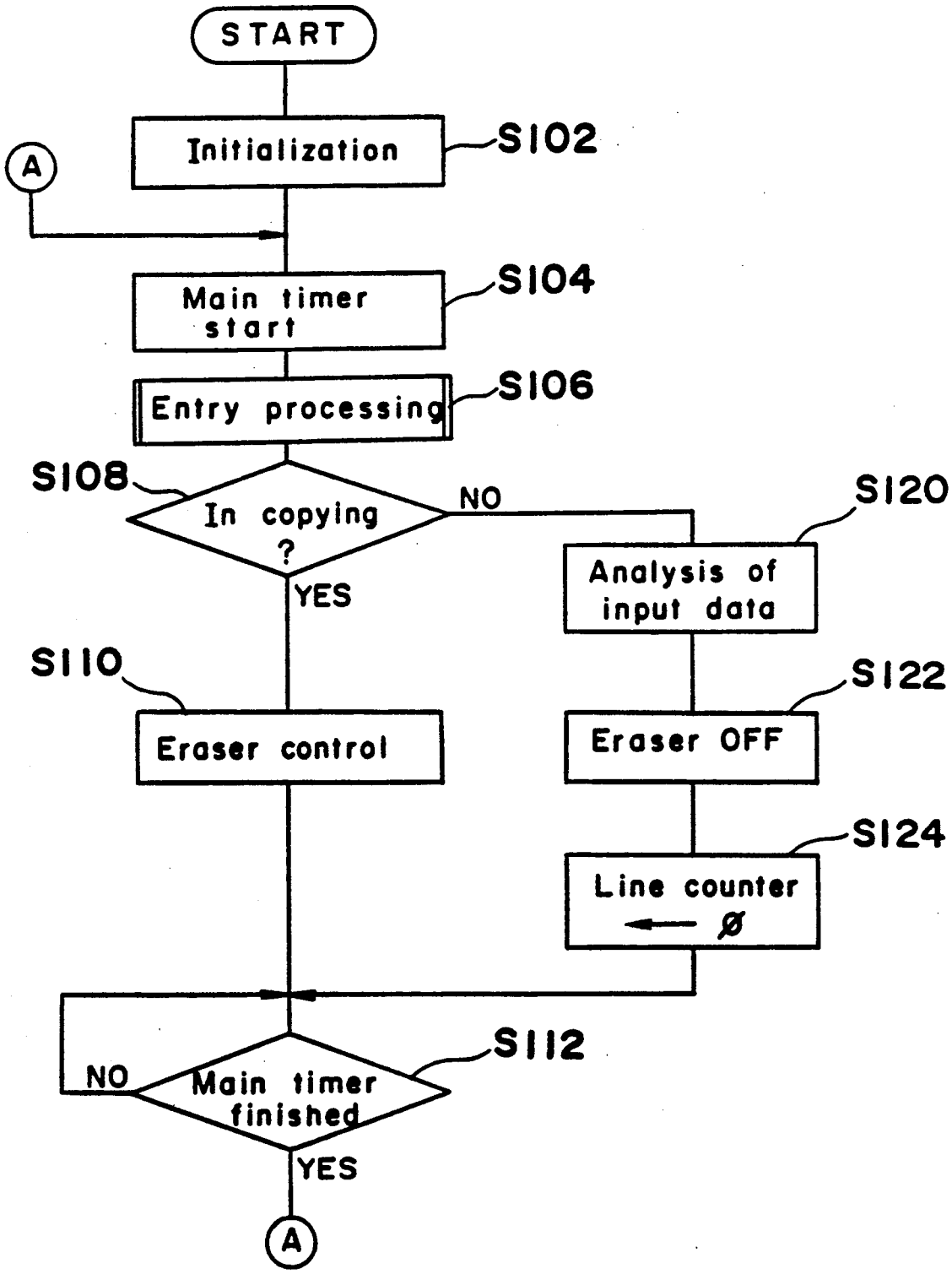
FIG. 9 is a flow chart of the subroutine for controlling the editor shown in FIG. 6.

FIG. 9 shows a flow chart of the control routine to be executed by the second CPU 150.

The second CPU 150 starts the program upon switching on the power source therefor and, at step S102, initialize memories, registers, flags and the like.

Next, at step S104, a main routine timer for regulating a time interval of one routine at step S104 and, at step S106, entry processing of data input from operation keys and sensors is executed. This step will be explained in detail later.

Then, it is checked at step S108 whether the copying machine is in copying or not from the signal transmitted from the first CPU 101.

If it is not in copying, data input from the editor 500 is analyzed at step S120 to set values for the designated editorial mode according to the entry data. If the simultaneous bi-color copy mode is designated, no processing is done at step S120.

Then, at step S122, all of LEDs of the sensor 8*a* are turned off and a line counter is cleared at step S124. The line counter is provided to use for reading out bit map data during driving the eraser 8*a* in the erasing, trimming or marking mode.

If the copying machine is in copying at step S108, the eraser 8*a* is controlled for driving individual LEDs thereof in accordance with the image forming action by the copying machine in order to performing the designated editorial mode.

Figure 10:
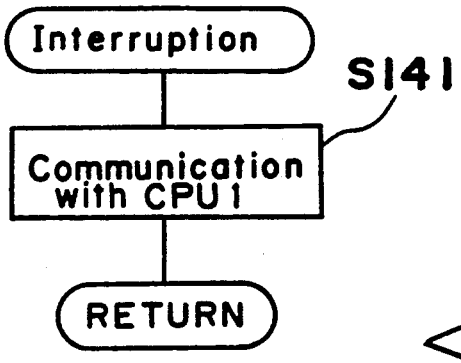
FIG. 10 is a flow chart of the interruption subroutine.

As shown in FIG. 10, the communication with the first CPU 101 is executed irrespective of the main routine by an interruption request from the first CPU 101.

Figure 11:
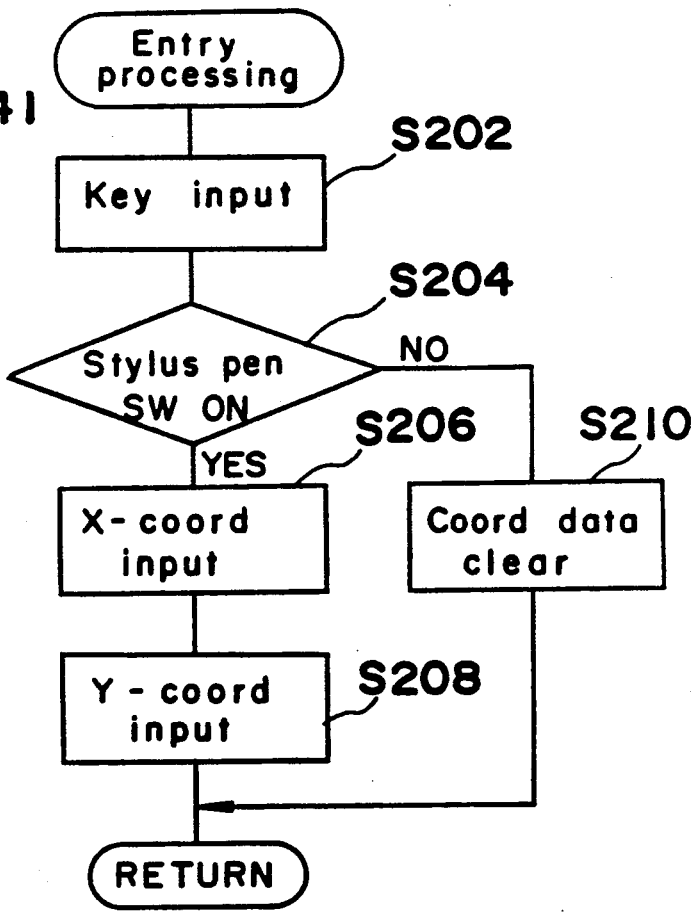
FIG. 11 is a flow chart of the subroutine for data entry processing.

FIG. 11 shows a flow chart of the subroutine (S106) for the processing of entry data from the editor 500.

At step S202, signal data from at least one of edition keys 520*a* to 520*j* and from the tablet 510 are accessed to store them in registers. Then, the state of the switch of the stylus pen 530 is checked at step S204.

If the switch is switched on by pushing down the stylus pen 530 on the tablet 510, X- and Y-coordinate data of the point instructed by the stylus- pen 530 are stored into a memory at step S206 and S208, respectively.

If the switch is in the off state, coordinate data are cleared at step S210.

Although only two developing units are provided in the preferred embodiment, the present invention is applicable to a copying machine providing three or more developing units.

The preferred embodiments described herein are illustrative and not restrictive, the scope of the invention being indicated by the appended claims and all variations which come within the meanings of the claims are intended to be embraced herein.

What is claimed is:

1. A copying machine comprising:

image forming means for forming an image on paper adapted to move in a paper moving direction and including plural developing units each of which contains a developer of a color different from each other;

editorial designation means for designating a kind of edition for editing images to be copied, said editorial designation means comprising mode designation means for designating a simultaneous multi-color mode in which the developing units are switched from one to another within one copying operation and a point entry means for designating an arbitrary point in an image of a document in orthogonal coordinates, said arbitrary point corresponding to an intersection of a first line extending in a direction perpendicular to the paper moving direction and a second line extending in a direction parallel to the paper moving direction; and control means, when said simultaneous multi-color mode is designated by operating said mode designation means and a point is designated by said point entry means, for operating said image forming means so as to switch the developing unit from one to another at the first line containing the point designated by said point entry means while ignoring the second line for all purposes in said simultaneous multi-color mode.

2. A copying machine as claimed in claim 1, in which said point entry means includes at least one operation key arranged on an operation panel of the machine.

3. A copying machine as claimed in claim 1, further comprising a display means for displaying the point designated by said point entry means.

4. A copying machine comprising:

imaging forming means for forming an image on paper adapted to move in a paper moving direction and including plural developing units each of which contains a developer of a color different from each other;

editorial designation means for designating a kind of edition for editing images to be copied, said editorial designation means comprising mode designation means for designating a simultaneous multi-color mode in which the developing units are switched from one to another within one copying operation and a point entry means for designating an arbitrary point in an image on a panel board having a size corresponding to the maximum size of a document, said point being contained in a first line extending perpendicular to the paper moving direction and a second line extending parallel to the paper moving direction; and control means, when said simultaneous multi-color mode is designated by operating aid mode designation means and a point is designated by said point entry means, for operating said image forming means so as to switch the developing unit from one to another at the first line containing the point designated by said point entry means while ignoring the second line for all purposes in said simultaneous multi-color mode.

5. A copying machine as claimed in claim 4, in which said point entry means comprises pen means for indicating an arbitrary point on said panel board and signal generation means for generating a signal indicating the indicated point.

6. A copying machine comprising:

image forming means for forming an image on paper adapted to move in a paper moving direction and including plural developing units each of which contains a developer of a color different form each other;

edition apparatus for editing images to be copied which includes first mode designation means for designating a simultaneous multi-color mode in which the developing units are switched from one to another within one copying operation and a first point entry means for designating a first arbitrary point in an image in orthogonal coordinates on a panel board having a size corresponding to the maximum copyable size, said edition apparatus being connectable to the copying machine;

edition means being provided in the copying machine for editing images to be copied in a manner designated, said edition means including second mode designation means for designating a simultaneous multi-color mode in which the developing units are switched from one to another within one copying operation and a second point entry means for designating a second arbitrary point in an image of a document in orthogonal coordinates; and control means for operating said image forming means so as to switch the developing unit from one to another at a line extending perpendicular to the paper moving direction containing the second point while ignoring Y-coordinate data of the orthogonal coordinates for all purposes in said simultaneous multi-color mode when a point is designated by said second point entry means and said simultaneous multi-color mode is designated from said second mode designation means, and at a line extending perpendicular to the paper moving direction containing the first point designated by said first point entry means while ignoring Y-coordinate data of the orthogonal coordinates for all purposes in said simultaneous multi-color mode when a point is designated by said first point entry means and said simultaneous multi-color mode is designated from said first mode designation means.

7. A copying machine as claimed in claim 6, further comprising a display means for displaying the point designated by said first or second point entry means.

* * * * *